US005625992A

United States Patent [19]

Strick et al.

[11] Patent Number: 5,625,992

[45] Date of Patent: May 6, 1997

[54] J-TRIM CORNER PIECE

[76] Inventors: Howard Strick, 1008 - 401 Athabasca Ave., Fort McMurray, Alberta, Canada, T9J 1H1; Robert Bedard, Box 133, Inwood, Manitoba, Canada, R0C 1P0

[21] Appl. No.: 404,815

[22] Filed: Mar. 14, 1995

[30] Foreign Application Priority Data

Mar. 15, 1994 [CA] Canada ..... 2119104

[51] Int. Cl.[6] ..... E06B 9/00

[52] U.S. Cl. ..... 52/656.9; 52/212

[58] Field of Search ..... 52/211, 212, 656.4, 52/656.5, 656.9

[56] References Cited

U.S. PATENT DOCUMENTS

| | | | |
|---|---|---|---|
| 4,326,365 | 4/1982 | Svensson | 52/211 |
| 4,608,800 | 9/1986 | Fredette | 52/211 X |
| 4,920,709 | 5/1990 | Garries et al. | 52/211 |
| 5,022,204 | 6/1991 | Anderson | 52/211 |
| 5,431,211 | 7/1995 | Guillemet | 52/656.9 X |
| 5,485,705 | 1/1996 | Guillemet | 52/656.9 |

FOREIGN PATENT DOCUMENTS

| | | | |
|---|---|---|---|
| 975921 | 10/1975 | Canada | 52/656.9 |
| 2625993 | 12/1977 | Germany | 52/656.5 |

*Primary Examiner*—Carl D. Friedman
*Assistant Examiner*—Aimee E. McTigue
*Attorney, Agent, or Firm*—Murray E. Thrift; Adrian D. Battison

[57] ABSTRACT

A corner piece is used with siding trim. At corners where strips of siding trim meet, the trim may be square cut and a corner piece inserted between the two square cut ends to finish the corner without using a miter or butt joint. The corner piece has a facing block that fits between the ends of two adjacent trim strips and two connector strips that project from two sides of the facing block to engage in the channels of the two trim strips. The coupling strips are preferably designed to snap fit into the trim strips.

4 Claims, 1 Drawing Sheet

J-TRIM CORNER PIECE

FIELD OF THE INVENTION

The present invention relates to building siding and more particularly to the trimming of building siding.

BACKGROUND

When installing manufactured siding, for example plastic siding, on a building, the siding is conventionally finished with trim strips around windows and doors, covering edges of the siding that would otherwise be exposed. The trim strips are cut with either mitre or butt joints at the corners where two strips meet. Cutting mitre joints is time consuming and significantly extends the time and effort required to complete a siding and trimming job. Butt joints, on the other end are not aesthetically pleasing, as they leave unfinished trim strip ends exposed.

The present invention proposes a corner piece that mitigates this problem.

SUMMARY

According to the present invention there is provided a corner piece for use with a pair of siding trim strips with adjacent, non-parallel end faces, said corner piece comprising a facing block configured to extend between the end faces of the respective trim strips, and coupling means projecting from the facing block for coupling engagement with the trim strips.

The corner piece thus fills the joint between two trim strip ends, so that the ends can be cut off square, avoiding the time and effort involved in mitering a corner. On the other hand, the corner piece finishes the ends of the trim strips to provide an attractive, finished look that cannot be achieved with a butt joint.

Conventionally the trim strips are channel shaped, having an outer, facing flange with an inwardly curved lip. The corner piece connectors may be similarly shaped to snap fit into the channel, under the curved lip.

The corner piece may be configured for use with perpendicular trim strips in a conventional right-angle joint, or it may accommodate other angles, for example a 135° included angle for use with an octagonal window. The facing block may match the configuration of the trim strips, or it may be ornamented for decorating the corners of the trim.

BRIEF DESCRIPTION OF THE DRAWINGS

An exemplary embodiment of the present invention will be described in the following in connection with the accompanying drawings, in which.

DETAILED DESCRIPTION

Figure 1:
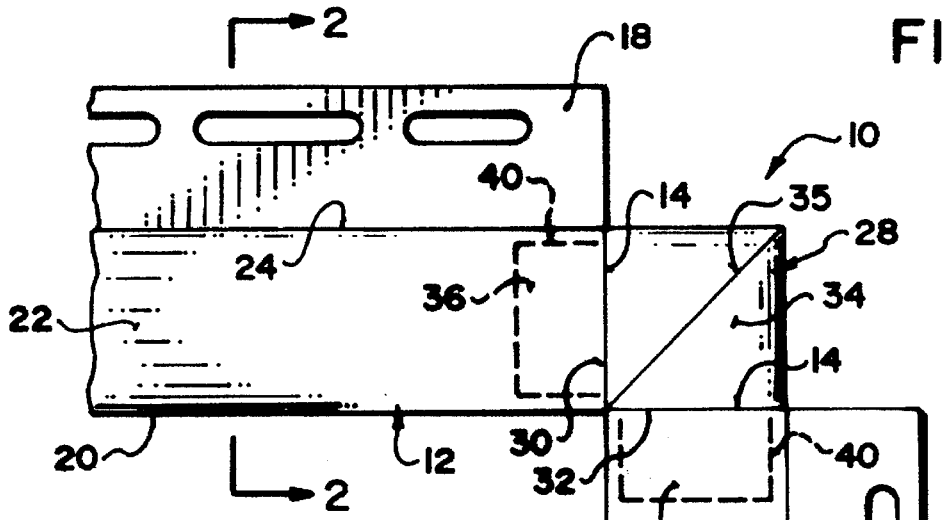
FIG. 1 is a front view of a trim strip corner using the corner piece.
Figure 2:
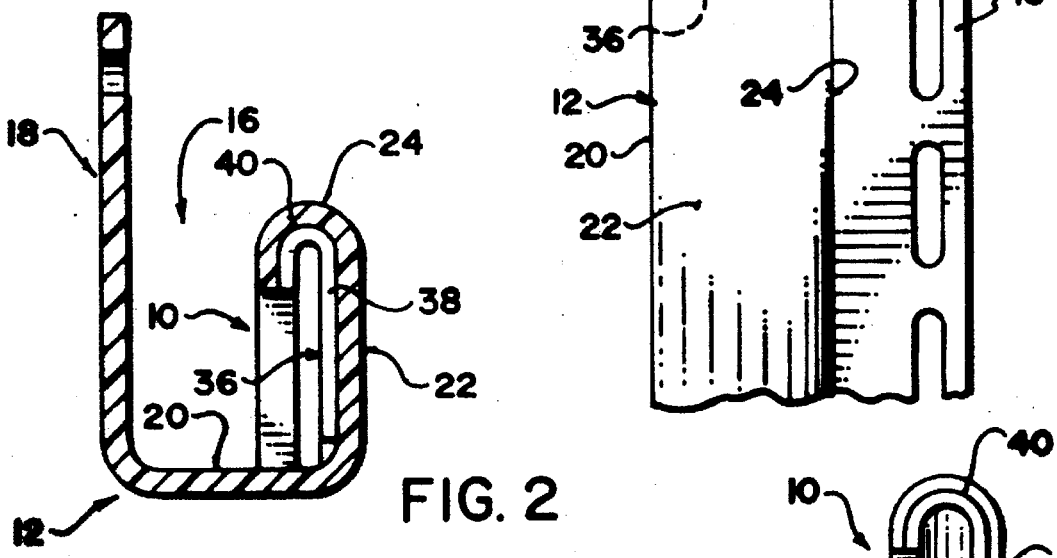
FIG. 2 is a sectional view along line 2—2 of FIG. 1.
Figure 3:
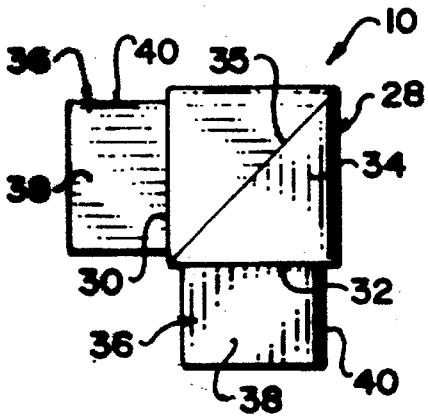
FIG. 3 is a front view of a corner piece.
Figure 4:
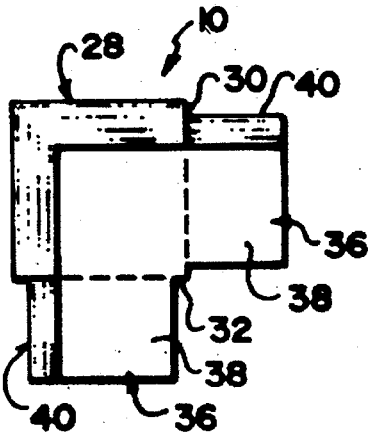
FIG. 4 is a back view of a corner piece.
Figure 5:
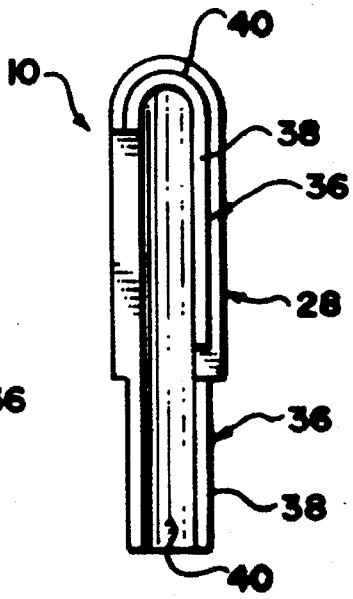
FIG. 5 is a side view of a corner piece.

Referring to the accompanying drawings, and especially to FIGS. 1 and 2, there is illustrated a corner piece 10 that is used in conjunction with two trim strips 12 having perpendicular ends 14 at a corner where the two trim strips meet. Each trim strip is configured as a channel 16 with a nailing strip 18 that mounts on a wall around the window or door opening being trimmed. A web 20 projects from the nailing strip and a facing flange 22 extends from the side of the web opposite the nailing strip. The free edge of the facing flange 22 is an inwardly curved lip 24. The channel between the nailing strip 18 and the facing flange 22 accommodates siding that is secured to the wall.

The corner piece 10 includes a facing block 28. In the illustrated embodiment is a square block with two side faces 30 and 32 that engage the end faces 14 of the trim strips 12. The facing block has a front face 34 that is, in this embodiment configured to represent a mitred corner, with two parts of the corner piece matching the respective trim strips in configuration and separated by a diagonal line 35.

The corner piece is fastened in place using two coupling strips 36 that project into the ends of the two trim strips 12. Each coupling strip has a flat panel 38 that lies on the inside face of the facing flange 22 and a curved lip 40 that fits under the curved lip 24 of the facing flange. With the trim strips and the corner piece made of a resilient thermoplastic material, the coupling strips may be a snap fit into the facing flanges 22 of the trim strips. Once in place, the engagement of the side faces 30 and 32 with the end faces of the respective trim strips and the engagement of the lips 40 of the coupling strips under the lips of the facing flanges secure the corner piece in place without the use of adhesives or other fasteners, although in some applications, use of an adhesive may be desirable.

In using the corner pieces, a window or door opening is readily trimmed using trim strips with square cut ends. Where desired, the web 20 of the trim strip may be left intact at a corner, with only the nailing strip and the facing flange being cut to allow bending of the web at a corner.

While a particular embodiment of the invention has been described in the foregoing, it is to be understood that other embodiments are possible within the scope of the invention. Thus, while the illustrated embodiment uses a square facing block, facing blocks of other configurations can be employed without departing from the scope of the invention. Facing blocks with ornamented faces or with other outline shapes may be employed to achieve various ornamental effects. It is also possible to arrange the facing block to couple trim strips at an angle other than 90°, to accommodate joints at different angles.

The invention is therefore to be considered limited solely by the scope of the appended claims.

We claim:

1. A siding trim assembly comprising, in combination, a pair of siding trim strips with adjacent, non-parallel end faces, each trim strip comprising:

a channel with an open side for extending over an edge of siding being trimmed and including;

a nailing strip; and a facing flange spaced from the nailing strip and having an inwardly curved lip extending partially over the open side of the channel; and a corner piece engaged between the two trim strips, said corner piece comprising:

a facing block having:

two adjacent non-parallel side faces engaged face-to-face with the respective end faces of the trim strips, with the facing block extending between the end faces of the respective trim strips: and two coupling means, each comprising:

a flat panel with an inwardly curved lip forming a J-shaped strip conforming in shape to the inside of the facing flanges, the coupling means projecting from the respective side faces of the facing block into the respective trim strip channels and into coupling engagement with the insides of the respective facing flanges.

2. The invention according to claim 1 wherein the facing block has an outer face conforming in shape and size to adjacent outer faces of the trim strip.

3. The invention according to claim 1 wherein the side faces of the facing block are perpendicular.

4. The invention according to claim 1 wherein the corner piece is formed of a thermoplastic material.

* * * * *